US008648578B2

(12) United States Patent
Zhao et al.

(10) Patent No.: US 8,648,578 B2
(45) Date of Patent: Feb. 11, 2014

(54) CAPLESS LOW DROP-OUT VOLTAGE REGULATOR HAVING DISCHARGE CIRCUIT COMPENSATING FOR ON-CHIP OUTPUT CAPACITANCE AND RESPONSE TIME

(75) Inventors: Hui Zhao, Shanghai (CN); Zhen Yang, Shanghai (CN)

(73) Assignee: NXP, B.V., Eindhoven (NL)

( * ) Notice: Subject to any disclaimer, the term of this patent is extended or adjusted under 35 U.S.C. 154(b) by 356 days.

(21) Appl. No.: 12/679,485

(22) PCT Filed: Sep. 29, 2008

(86) PCT No.: PCT/IB2008/053952

§ 371 (c)(1), (2), (4) Date: Jun. 22, 2010

(87) PCT Pub. No.: WO2009/044326

PCT Pub. Date: Apr. 9, 2009

(65) Prior Publication Data

US 2010/0277148 A1 Nov. 4, 2010

(30) Foreign Application Priority Data

Sep. 30, 2007 (CN) ..... 2007 1 0164217

(51) Int. Cl.
*G05F 1/613* (2006.01)

(52) U.S. Cl.
USPC ..... 323/226; 323/269; 323/273; 361/56

(58) Field of Classification Search
USPC ..... 323/226, 269, 273–281
See application file for complete search history.

(56) References Cited

U.S. PATENT DOCUMENTS 4,118,749 A * 10/1978 Matuzaki et al. ..... 361/33
4,723,191 A 2/1988 Menniti
5,530,395 A * 6/1996 Ting ..... 327/543

(Continued)

FOREIGN PATENT DOCUMENTS

CN 1912791 A 2/2007
EP 0280514 A1 8/1988

(Continued)

OTHER PUBLICATIONS

International Search Report for Int'l Patent Appln. No. PCT/IB2008/053952 (Jan. 30, 2009), Published as WO 2009/044326 A1.

*Primary Examiner* — Adolf Berhane
*Assistant Examiner* — Gustavo Rosario Benitez

(57) ABSTRACT

A voltage regulator is provided having one or more discharger circuits that compensate for low on-chip output capacitance and a slow loop response time. In one embodiment, the voltage regulator includes an output transistor coupled to an output voltage line, an output voltage sensing arrangement coupled to the output voltage line for producing an output feedback voltage, and an error amplifier coupled to the output feedback voltage, the output transistor, and a reference voltage for applying feedback control to the output transistor. A first discharger circuit is coupled to the output voltage line and to a reference potential, the first discharger circuit being triggered by a steep-rise overvoltage condition. In another embodiment, a combination of fast and slow discharger circuits is used to improve the load step response—i.e., to stop the output voltage from jumping too high and to pull it back to stable value very quickly, such that the load circuits are protected.

16 Claims, 2 Drawing Sheets

(56) References Cited

U.S. PATENT DOCUMENTS

| | | | | |
|---|---|---|---|---|
| 5,559,660 | A * | 9/1996 | Watson et al. | 361/58 |
| 5,815,012 | A * | 9/1998 | Rivoir et al. | 327/103 |
| 5,946,177 | A * | 8/1999 | Miller et al. | 361/56 |
| 6,201,375 | B1 * | 3/2001 | Larson et al. | 323/277 |
| 6,445,167 | B1 * | 9/2002 | Marty | 323/280 |
| 6,465,994 | B1 | 10/2002 | Xi | |
| 6,744,242 | B1 | 6/2004 | Giacomotto et al. | |
| 6,807,039 | B2 * | 10/2004 | Priest | 361/93.1 |
| 7,102,862 | B1 * | 9/2006 | Lien et al. | 361/56 |
| 7,545,614 | B2 * | 6/2009 | Traynor et al. | 361/56 |
| 2003/0178980 | A1 | 9/2003 | Biagi et al. | |
| 2007/0080977 | A1 * | 4/2007 | Sato | 347/5 |
| 2008/0007882 | A1 * | 1/2008 | Bernard et al. | 361/56 |

FOREIGN PATENT DOCUMENTS

| | | | |
|---|---|---|---|
| EP | 1365302 | A1 | 11/2003 |
| EP | 1378808 | A1 | 1/2004 |
| EP | 1596266 | A1 | 11/2005 |

* cited by examiner

CAPLESS LOW DROP-OUT VOLTAGE REGULATOR HAVING DISCHARGE CIRCUIT COMPENSATING FOR ON-CHIP OUTPUT CAPACITANCE AND RESPONSE TIME

Traditional LDO voltage regulators require an external capacitor to make the output voltage stable. To increase battery life and save PCB area in portable applications, a low quiescent current, "capless" LDO voltage regulator is increasingly used. However, these capless LDO voltage regulators experience problems when the load current changes very fast, e.g. from several tens of milliamperes to zero in less than ins. The output voltage will jump to the supply voltage due to limited on-chip output capacitance and slow loop response. Furthermore, after jumping up, the output voltage falls down to normal value very slowly, depending on the resistance of a resistor divider and the capacitance of the on-chip capacitor. As a result, the output voltage of the LDO voltage regulator will deviate from the normal value and stay around the supply voltage for a prolonged period of time. Inevitably, the low voltage load circuits will be destroyed or malfunction as a result.

An improved voltage regulator is needed that retains the advantages of capless LDO voltage regulators but that is not as susceptible to overvoltage conditions like the ones described.

A voltage regulator and voltage regulation method are provided wherein one or more discharger circuits compensate for low on-chip output capacitance and slow loop response time. In one embodiment, the voltage regulator includes an output transistor coupled to an output voltage line, an output voltage sensing arrangement coupled to the output voltage line for producing an output feedback voltage, and an error amplifier coupled to the output feedback voltage, the output transistor, and a reference voltage for applying feedback control to the output transistor. A first discharger circuit is coupled to the output voltage line and to a reference potential, the first discharger circuit being triggered by a steep-rise overvoltage condition. In another embodiment, a combination of fast and slow discharger circuits is used to improve the load step response—i.e., to stop the output voltage from jumping too high and to pull it back to a stable value very quickly, such that the load circuits are protected. The circuit can be made to consume very low power (e.g., about 5 μA static current) and exhibit very high speed. In an exemplary embodiment, the circuit can handle a full-range load step (rising/falling) as fast as 1 ns.

Other features and advantages will be understood upon reading and understanding the detailed description of exemplary embodiments, found herein below, in conjunction with reference to the drawings, a brief description of which is provided below.

There follows a more detailed description of the present invention. Those skilled in the art will realize that the following detailed description is illustrative only and is not intended to be in any way limiting. Other embodiments of the present invention will readily suggest themselves to such skilled persons having the benefit of this disclosure. Reference will now be made in detail to embodiments of the present invention as illustrated in the accompanying drawings. The same reference indicators will be used throughout the drawings and the following detailed description to refer to the same or like parts.

Figure 4:
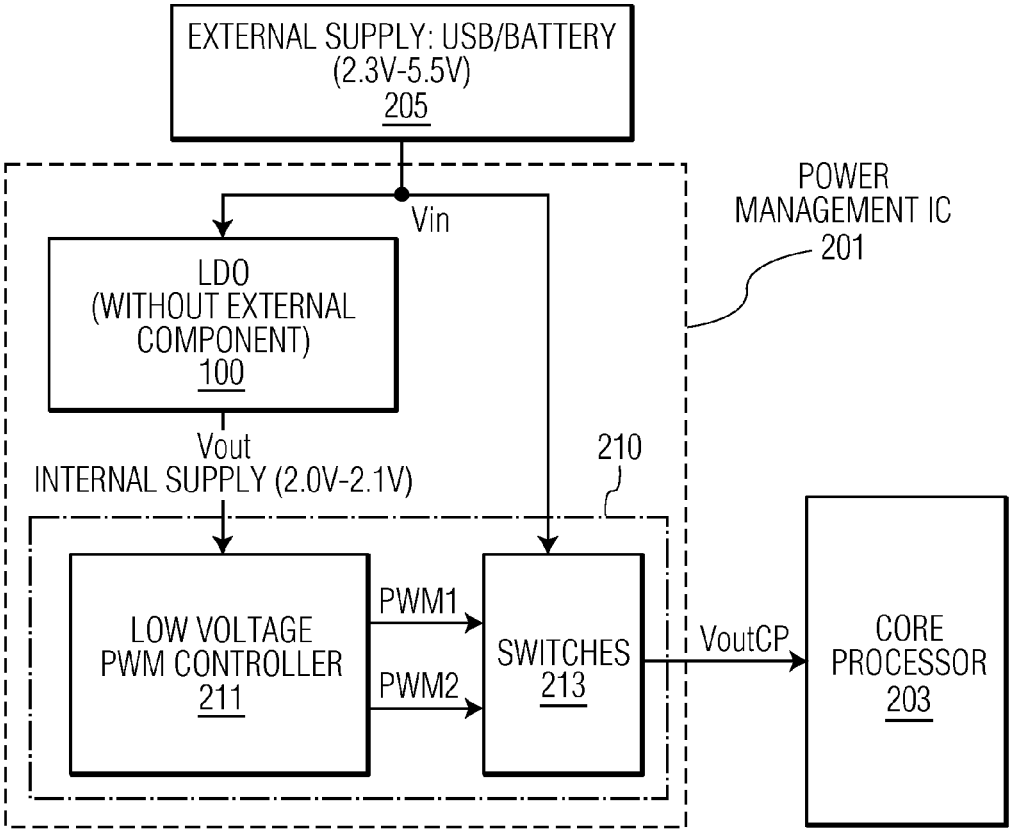
FIG. 4 is a block diagram illustrating one application of the voltage regulator of FIG. 1.

Referring first to FIG. 4, one possible application is shown of a voltage regulator 100, described in greater detail hereinafter. The voltage regulator 100 forms part of a power management IC 201 that supplied power to a core processor 203. The core processor 203 may be the processor of a mobile electronic device, for example. Power is supplied to the power management IC 201 from an external battery or USB device 205, which provides an input voltage Vin. The input voltage Vin is applied to the voltage regulator 100 and to a switching power supply 210 that includes a low voltage pulse width modulation (PWM) controller 211 and switches 213. An output voltage Vout of the voltage regulator 100 serves as an internal power supply for the PWM controller 211. The PWM controller produces control signals (e.g., PWM1, PWM2) that are applied to switches 213 along with the input voltage Vin. By suitable control of the switches 213, the input voltage Vin is converted to a voltage Voutcp used to supply the core processor 203.

Figure 1:
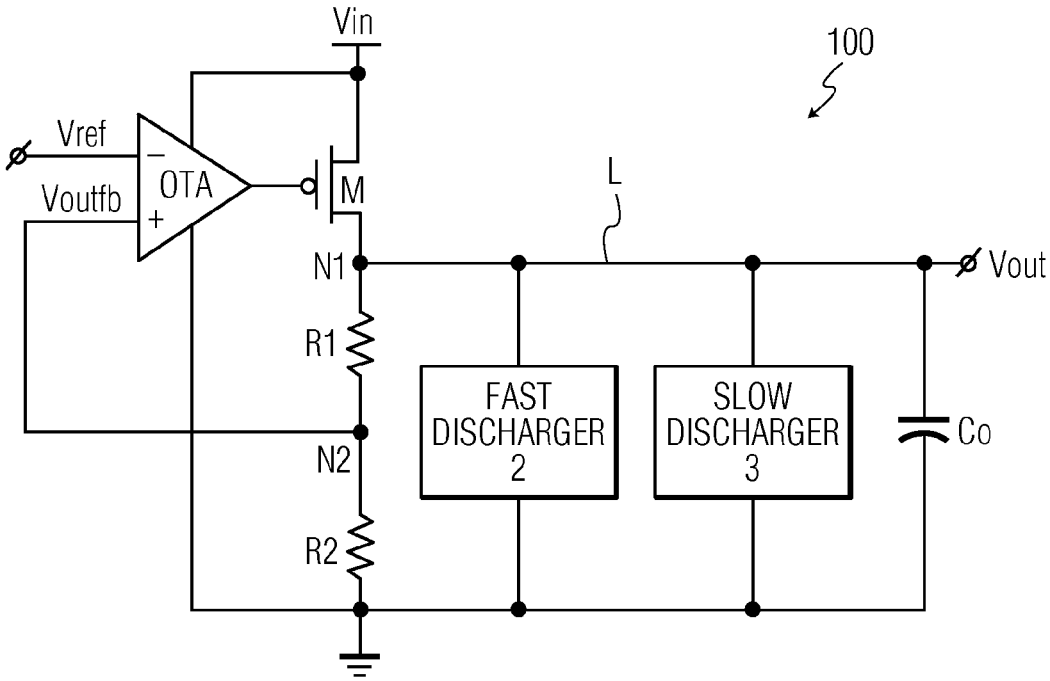
FIG. 1 is a simplified circuit diagram of a voltage regulator with fast load step response.

Referring now to FIG. 1, a circuit diagram is shown of a voltage regulator (capless LDO voltage regulator) having a fast overvoltage response. The voltage regulator is preferably realized in the form of a single integrated circuit. The basic structure of the voltage regulator includes an output transistor M, an output voltage sensing arrangement in the form of a resistive divider R1, R2, an error amplifier OTA, and an output capacitor Co. The output transistor M is preferably a PMOS transistor. It is coupled in series with the resistive divider R1, R2. The series combination of the output transistor M and the resistive divider R1, R2 is connected between the supply voltage Vin and ground. An output voltage line L is connected to a node N1 between the output transistor M and the resistive divider R1, R2, across which an output voltage Vout is produced. At an intermediate node N2 of the resistive divider R1, R2, a feedback voltage is produced, indicative of the output voltage Vout.

The power supply terminals of the error amplifier OTA are also connected to the supply voltage Vin and ground. The negative input terminal of the error amplifier OTA is connected to a reference voltage Vref. The positive input terminal of the error amplifier OTA is connected to the feedback voltage Voutfb. An output terminal of the error amplifier OTA is connected to a gate electrode of the output transistor M. The conduction state of the output transistor M is thereby controlled by a feedback loop in accordance with the difference between the reference voltage Vref and a feedback voltage Voutfb. The output capacitor Co is coupled between the output line L and ground and serves to smooth out variations in the output voltage Vout.

A fast discharger circuit 2 is connected between the output voltage line L and ground. The fast discharger circuit will be described in more detail in connection with FIG. 2. Optionally, a slow discharger circuit 3 is also connected between the output voltage line L and ground. The slow discharger circuit will be described in more detail in connection with FIG. 3.

Figure 2:
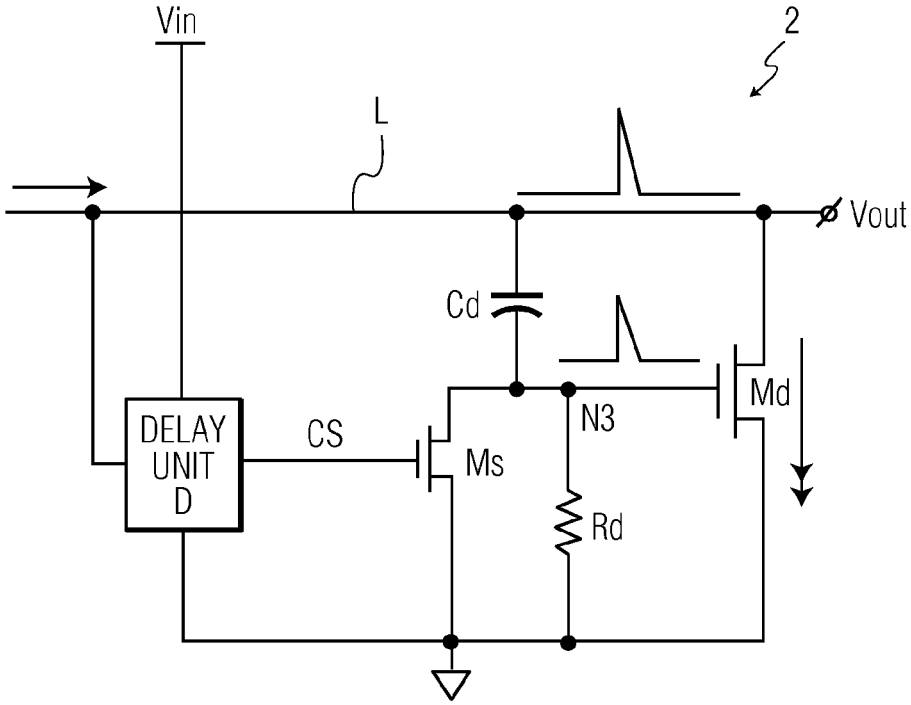
FIG. 2 is a circuit diagram illustrating in greater detail the fast discharger circuit of FIG. 1.

Referring now to FIG. 2, the fast discharger circuit includes a discharge transistor Md, which may be an NMOS transistor, connected between the output voltage line L and ground. A trigger circuit is connected in parallel with the discharge transistor Md and includes a capacitor Cd and a resistor Rd. A gate electrode of the discharge transistor Md is connected to a node N3 between the capacitor Cd and the resistor Rd. In operation, when Vout rises very fast, Cd behaves as a short circuit, and the transistor Md will be triggered ON to pull Vout down.

A start-up transistor Ms is connected in parallel with the resistor Rd. It is used to bypass the resistor Rd during a power-up event to avoid mis-triggering of the discharge transistor Md. A delay unit D is connected to the output voltage line L and produces a control signal CS connected to a gate electrode of the start-up transistor Ms. The delay unit D is also connected to the supply voltage Vin and ground. Normally, the control signal CS is low, and the start-up transistor Ms is OFF. During a power-on event, however, the control signal CS is raised high, turning on the start-up transistor Md and preventing the discharge transistor Md from being turned on. When the output voltage Vout has stabilized, the control signal CS is lowered, turning the start-up transistor Ms OFF.

The fast discharger 2 does not consume static current, and when the output voltage begins to rise very fast, the fast discharger circuit 2 will trigger with zero time delay and discharge the output node. It thereby effectively limits the peak value of the output voltage to within a safe range and pulls the output voltage back to a normal value very fast, protecting the low voltage load circuits from damage.

Figure 3:
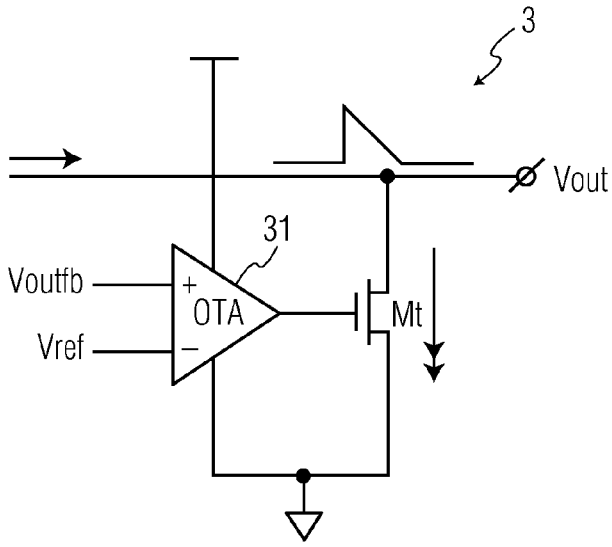
FIG. 3 is a circuit diagram illustrating in greater detail the slow discharger circuit of FIG. 1.

The fast discharger circuit 2 is most efficient for abrupt overvoltage conditions. To improve efficiency for less-abrupt overvoltage conditions, a slow discharger circuit 3 may be provided. The slow discharge circuit 3 may have a construction as shown in FIG. 3. A discharge transistor Mt (preferably NMOS) is connected between the output voltage line and ground. It is controlled by an unbalanced voltage comparator 31. The power supply terminals of the voltage comparator 31 are connected to the supply voltage Vin and ground. The negative input terminal of the voltage comparator is connected to a reference voltage Vref. The positive input terminal of the voltage comparator 31 is connected to the feedback voltage Voutfb.

When the output voltage rises less abruptly, the slow discharger circuit 3 can ensure that the output voltage is reduced to a normal value very quickly. The unbalanced feature of comparator is to ensure that transistor Mt will not be mis-triggered ON when offset voltages exists due to process and mismatch variations.

Although embodiments of the present invention have been described in detail, it should be understood that various changes, substitutions and alternations can be made without departing from the spirit and scope of the inventions as defined by the appended claims.

What is claimed is:

1. A voltage regulator comprising: an output transistor coupled to an output voltage line; an output voltage sensing arrangement coupled to the output voltage line for producing an output feedback voltage; an error amplifier coupled to the output feedback voltage, the output transistor, and a reference voltage for applying feedback control to the output transistor; and a first discharger circuit coupled to the output voltage line and to a reference potential, the first discharger circuit being triggered by a steep-rise overvoltage condition, wherein the first discharger circuit comprises: a first shunt transistor coupled between the output voltage line and a reference potential; a trigger circuit coupled to the output voltage line and the first shunt transistor, wherein the trigger circuit comprises a series combination of a capacitor and a resistor; and a bypass transistor having a first terminal and a second terminal, wherein the first terminal is coupled to a node between the capacitor and the resistor that are connected in series, wherein the second terminal is coupled to ground, wherein the first terminal of the bypass transistor is a source terminal or a drain terminal, wherein a gate electrode of the first shunt transistor is connected to the node between the capacitor and the resistor that are connected in series, wherein the bypass transistor is connected in parallel with the resistor, and wherein the first terminal of the bypass transistor and the gate electrode of the first shunt transistor are directly connected to the node between the capacitor and the resistor that are directly connected in series.

2. The voltage regulator of claim 1, wherein the series combination of the capacitor and the resistor is coupled between the output voltage line and the reference potential.

3. The voltage regulator of claim 1, the bypass transistor being turned on immediately following a power-up event.

4. The voltage regulator of claim 3, comprising a delay circuit coupled to the output voltage line and the bypass transistor for turning off the bypass transistor after a delay time has elapsed following the power-up event.

5. The voltage regulator of claim 1, comprising a second discharger circuit, the second discharger circuit having a response time greater than a response time of the first discharger circuit.

6. The voltage regulator of claim 5, wherein the second discharger circuit comprises a second shunt transistor and a comparator coupled to the output voltage line, ground and the second shunt transistor for controlling the second shunt transistor.

7. The voltage regulator of claim 6, wherein the comparator is unbalanced to avoid mis-triggering of the second shunt transistor due to fabrication process variations.

8. The voltage regulator of claim 1, wherein the error amplifier is a cascode transconductance amplifier.

9. The voltage regulator of claim 1, formed on an single integrated circuit.

10. The voltage regulator of claim 8, comprising an output capacitor coupled to the output voltage line and formed on the integrated circuit.

11. A method of regulating an output voltage using an output transistor coupled to an output voltage line and a first discharger circuit, the method comprising:

sensing the output voltage; applying feedback control to the output transistor according to the sensed output voltage, said feedback control entailing a delay; and apart from said feedback control, a steep-rise overvoltage condition causing the first discharger circuit to shunt current from the output voltage line, wherein the first discharger circuit comprises:

a first shunt transistor coupled between the output voltage line and a reference potential; a trigger circuit coupled to the output voltage line and the first shunt transistor, wherein the trigger circuit comprises a series combination of a capacitor and a resistor; and a bypass transistor having a first terminal and a second terminal, wherein the first terminal is coupled to a node between the capacitor and the resistor that are connected in series, wherein the second terminal is coupled to ground, wherein the first terminal of the bypass transistor is a source terminal or a drain terminal, wherein a gate electrode of the first shunt transistor is connected to the node between the capacitor and the resistor that are connected in series, and wherein the bypass transistor is connected in parallel with the resistor, and wherein the first terminal of the bypass transistor and the gate electrode of the first shunt transistor are directly connected to the node between the capacitor and the resistor that are directly connected in series.

12. The method of claim 11, wherein the first discharger circuit has a response time much less than said delay.

13. The method of claim 11, comprising preventing the first discharger circuit from operating during a power-on event.

14. The method of claim 11, comprising causing a second discharger circuit to shunt current from the output voltage line in response to the sensed output voltage.

15. The method of claim 13, wherein the first discharger circuit provides fast response to an abrupt over-voltage condition, and the second discharger circuit provides for more efficient discharge in the case of a less-abrupt over-voltage condition.

16. The voltage regulator of claim 5, wherein the first discharger circuit provides fast response to an abrupt over-voltage condition, and the second discharger circuit provides for more efficient discharge in the case of a less-abrupt over-voltage condition.

* * * * *